United States Patent [19]

Kobayashi et al.

[11] Patent Number: 4,579,633

[45] Date of Patent: Apr. 1, 1986

[54] METHOD OF PRODUCING TIN-FREE STEEL SHEETS

[75] Inventors: Hideo Kobayashi; Hajime Ogata; Shunichi Tsugawa, all of Chiba; Motoharu Hamada, Yotsukaido; Shunichi Harada, Chiba, all of Japan

[73] Assignee: Kawasaki Steel Corporation, Hyogo, Japan

[21] Appl. No.: 498,547

[22] Filed: May 26, 1983

[51] Int. Cl.[4] ..... C25D 5/48; C25D 11/38

[52] U.S. Cl. ..... 204/27; 204/32.1; 204/35.1; 204/40

[58] Field of Search ..... 204/27, 28, 35 R, 35 N, 204/40, 41, 56 R, 32.1

[56] References Cited

U.S. PATENT DOCUMENTS 3,642,587 2/1972 Allen et al. ..... 204/35 N
3,772,165 11/1973 Yamagishi et al. ..... 204/28
3,890,164 6/1975 Harada et al. ..... 148/6.2
3,986,940 10/1976 Takano et al. ..... 204/28
4,432,842 2/1984 Inui et al. ..... 204/41

*Primary Examiner*—John F. Niebling
*Assistant Examiner*—William T. Leader
*Attorney, Agent, or Firm*—Young & Thompson

[57] ABSTRACT

Tin-free steel sheets having intimately bonded metallic chromium and hydrated chromium oxide coatings thereon and possessing improved resistance to retorting treatment and improved adhesion to paint films to be applied thereon are produced by chromium plating a steel sheet in a chromium plating bath containing an assistant to deposit and form metallic chromium and hydrated chromium oxide coatings on the sheet surface, subjecting the sheet to reverse electrolysis in the same chromium plating bath to partially dissolve away the metallic chromium and hydrated chromium oxide coatings together with the assistant anions codeposited in the hydrated chromium oxide coating, rinsing the sheet with water, and thereafter subjecting the sheet to an electrolytic chromate treatment in an electrolytic chromate treating bath.

2 Claims, 3 Drawing Figures

(x10000)

(x10000)

METHOD OF PRODUCING TIN-FREE STEEL SHEETS

BACKGROUND OF THE INVENTION

This invention relates to a method of producing tin-free steel sheets having improved adhesion between metallic chromium and hydrated chromium oxide coatings and between the hydrated chromium oxide coating and a paint film, and exhibiting improved resistance to a retorting treatment.

One of the prior art methods for producing tin-free steel sheets uses two separate baths to deposit metallic chromium in one bath and then deposit a hydrated chromium oxide coating in a separate bath. This method has the benefit of easily controlling the thickness of the respective coatings. Particularly when a chromic acid solution is used as the electrolytic chromate treating bath as disclosed in Japanese Patent Publication No. 47-35172, the amount of hydrated chromium oxides deposited is increased in proportion to the quantity of electrically for electrolysis, enabling accurate control of the deposition amount. However, since the baths used in the double bath method have different compositions, transferring chromium plated steel sheets to an electrolytic chromate treating bath directly from a chromium plating bath introduces the possibility that the anion of a plating assistant which has been codeposited in the hydrated chromium oxide coating during chromium plating is left in the coating of the final product, the chromium plating solution entrained on the steel sheet surface is carried into the electrolytic chromate treating bath to vary the amount of hydrated chromium oxides deposited, and that portion of the codeposited assistant anion which is partially dissolved out is again codeposited. To avoid such undesirable problems, the chromium plated steel sheet should be fully rinsed with water before it is passed into the electrolytic chromate treating bath. However, it has been found that rinsing after chromium plating is insufficient to remove the chromium plating assistant anion which has been codeposited with hydrated chromium oxides during chromium plating. Particularly when chromium plating uses sulfuric acid or its derivatives as the assistant, in spite of the subsequent electrolytic chromating treatment in a chromate bath, the sulfate residues codeposited are left in the final hydrated chromium oxide coating and detract from its adhesion to a paint film.

Making extensive investigations to eliminate the shortcomings of the double bath method of producing tin-free steel sheets, the inventors have found that by subjecting a steel sheet which has been chromium plated in a chromium plating bath to reverse electrolysis in the same bath such that the hydrated chromium oxides formed during chromium plating and the assistant anion codeposited therewith may be decreased, thereafter fully rinsing the chromium plated steel sheet with water and subjecting it to an electrolytic chromate treatment in an aqueous chromic acid solution bath, the retorting resistance of the steel sheet is significantly improved.

SUMMARY OF THE INVENTION

It is, therefore, an object of the invention to provide a novel and improved method of producing tin-free steel sheets having improved retorting resistance.

According to the present invention, there is provided a method for producing a tin-free steel sheet having a metallic chromium coating and a hydrated chromium oxide coating formed thereon and exhibiting improved retorting resistance, comprising the steps of chromium plating a steel sheet in a chromium plating bath containing at least one assistant as well as chromic acid to deposit and form metallic chromium and hydrated chromium oxide coatings on the sheet surface, subjecting the thus plated steel sheet to reverse electrolysis in the same chromium plating bath to cause the metallic chromium and hydrated chromium oxide coatings to be partially dissolved out together with the assistant anions codeposited in the hydrated chromium oxide coating, fully rinsing the steel sheet in a water bath, and thereafter subjecting the steel sheet to an electrolytic chromate treatment in an electrolytic chromate treating bath.

BRIEF DESCRIPTION OF THE DRAWINGS

The above and other objects, features, and advantages of the invention will be more fully understood by reading the following description in conjunction with the accompanying drawings, in which.

DESCRIPTION OF THE INVENTION

Figure 1:
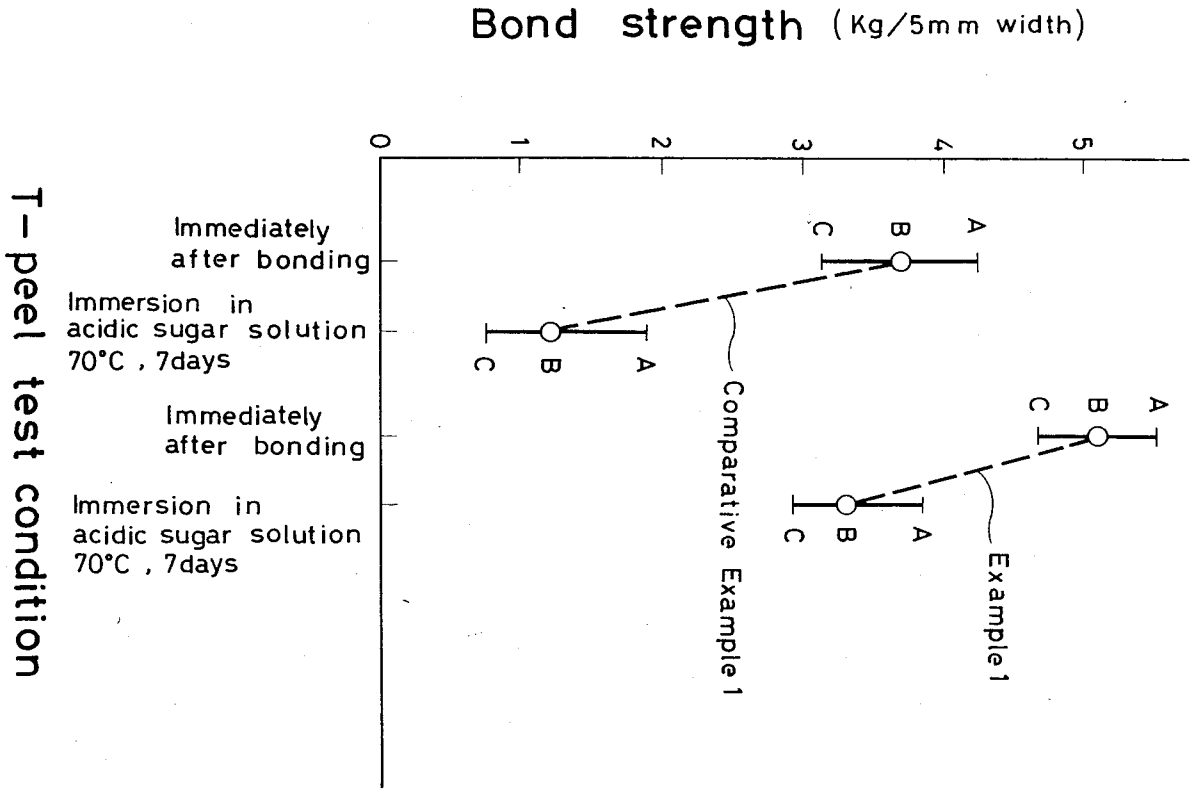
FIG. 1 is a graph showing the results of T-peel strength tests made on specimens of Example 1 of the present invention and of Comparative Example 1 of the prior art.

By subjecting a chromium plated steel sheet to reverse electrolysis in the chromium plating bath in which the sheet has been chromium plated, the hydrated chromium oxide and metallic chromium which have been deposited during chromium plating are partially dissolved away, smoothing the irregular surface of the metallic chromium coating. During or after the reverse electrolysis, an anodic coating is formed which is of different nature from the conventional cathodic coating. This anodic coating is found to have a minimal content of the assistant anion codeposited. After the thus treated steel sheet is rinsed in a water bath and subjected to an electrolytic chromate treatment, the resulting steel sheet exhibits improved retorting resistance.

The present invention is directed to tin-free steel sheets having a plating of metallic chromium ranging from 20 to 200 mg per square meter on each surface of a cold rolled steel sheet and a coating of hydrated chromium oxides ranging from 5 to 50 mg per square meters on the metallic chromium plating surface. These tin-free steel sheets are generally coated with paint before use. More particularly, the steel sheet is coated with a paint on one surface and baked, during which the other surface is also baked without a covering. Thereafter, the other surface is coated with another paint and baked. A piece cut from the double-side coated steel sheet is rounded to place its edges in contact, and the contacting edges are bonded with an organic adhesive to form a can barrel. In order that tin-free steel sheets may have improved adhesion to paint films and be resistant to any retorting treatment after packing of contents, the tin-free steel sheet producing method of the present invention is characterized by the steps of chromium plating a steel sheet in a common chromium plating bath containing an anion-forming assistant such as sulfuric acid or its derivatives, subjecting the steel sheet to reverse electrolysis in the same bath with an electricity quantity of 0.1 to 15 coulomb/dm$^2$, rinsing it in a water bath, and then subjecting it to an electrolytic chromate treatment in an aqueous chromic acid solution. Thinner coatings of metallic chromium of less than 20 mg/m$^2$ have poor corrosion resistance because of increased microcracks and pinholes while thicker coatings exceeding 200 mg/m$^2$ do not achieve an additional improvement in corrosion resistance. Chromium plated steel sheets generally have 20 to 200 mg/m$^2$ of a metallic chromium coating for this reason.

Thinner coatings of hydrated chromium oxides of less than 5 mg/m$^2$ do not provide the necessary adhesion to paint films while thicker coatings exceeding 50 mg/m$^2$ have a poor appearance and are thus unsuitable for commercial use. Reverse electrolysis with an electricity quantity of less than 0.1 coulomb/dm$^2$ is insufficient to dissolve away the hydrated chromium oxide coating and metallic chromium. An electricity quantity exceeding 15 coulomb/dm$^2$ is impractical because of excessive dissolution of metallic chromium.

In general, tin-free steel sheets are produced either by the single bath method in which metallic chromium and hydrated chromium oxides are simultaneously deposited using an electrolytic chromic acid bath based on a low concentration of chromic acid, or by the double bath method mentioned earlier. The present invention provides a method of producing tin-free steel sheets having improved retorting resistance by modifying the hyrated chromium oxide coating formed by the double bath method.

As is well known in the prior art, chromium plating baths should contain anion-forming assistants alone or in admixture, for example, sulfuric acid for Sargent baths and sodium silicofluoride for fluoride baths in addition to the main ingredient, chromic acid because metallic chromium cannot be deposited from chromic acid bath without such an assistant. During the chromium plating, these assistant anions act to scissor the hydroxy bond of ol compounds in which lower valence chromium ions formed by intermediate reduction of hexavalent chromium ions have hydroxyl groups attached or have water adsorbed, and penetrate into the coating to dissolve it. Then, the coating is renewed by this dissolution and always kept thin. Furthermore, the assistant anions which have penetrated into the coating coordinate with lower valence chromium ions and substitute for hydroxyl groups or water, promoting the deposition of metallic chromium by reduction. Therefore, the presence of assistant anions is essential for chromium plating, and the hydrated chromium oxide coating formed during the chromium plating has a substantial amount of the anions codeposited. The assistant anions codeposited are not removed by rinsing and an electrolytic chromate treatment, and remain in the final tin-free steel sheet.

Anions of the assistant used for chromium plating are codeposited in a large proportion in the hydrated chromium oxide coating as described above, and these codeposited anions have a substantial influence on the adhesion of the coating to paint. More specifically, since the anions are codeposited by substituting for hydroxyl groups or bound water which is necessary to form hydrogen bonds with the paint, the hydrated chromium oxide coating tends to reduce its adhesion to paint because of a shortage of bonding sites required for paint adhesion. Furthermore, these anions remain in the hydrated chromium oxides after the baking of paint films and are undesirably dissolved out during any retorting process at the time of packing of contents or after the lapse of time, detracting from retorting resistance.

It is thus necessary to lessen the anions left after the electrolytic chromate treatment. It may appear effective to this end to reduce the content of an assistant in a chromium plating bath. This is, however, impractical because the efficiency of deposition of metallic chromium is lowered and the appearance becomes less attractive.

It also appears effective to rinse chromium plated steel sheets with hot water, which is, however, still insufficient to remove the anions in the hydrated chromium oxide coating. It is also still unsatisfactory to further rinse chromium plated steel sheets after they are subjected to an electrolytic chromate treatment. As opposed to these measures, the reverse electrolysis used in the method of the present invention has succeeded in substantially decreasing the amount of assistant anions which are codeposited during the chromium plating and retained after the electrolytic chromate treatment and are difficult to be removed by any of the prior art methods, thereby substantially improving retorting resistance.

Tin-free steel sheets were produced by the method according to the present invention (Examples 1–3) and by the prior art method (Comparative Examples 1–3), and examined by a T-peel test, coating surface analysis, and surface observation under an electron microscope. The procedures will be described in detail.

EXAMPLE 1

Cold rolled steel sheets having a thickness of 0.22 mm were electrolytically degreased in a 5% homezarine solution at 80° C. with a current density of 15 A/dm$^2$ for 10 seconds, rinsed with water, immersed in a 10% sulfuric acid at room temperature for 5 minutes, and rinsed with water again before they were subjected to a plating treatment under the following conditions.

Chromium plating

Bath composition: $CrO_3$ 250 g/l + $H_2SO_4$ 2.5 g/l
Bath temperature: 55° C.
Electrolytic conditions: 50 A/dm$^2$, 1.0 sec.

After the chromium plating, the steel sheets were subjected to reverse electrolysis in the same bath under the following conditions.

Reverse electrolysis

Anode: chromium plated steel sheet
Electrolytic conditions: 2 A/dm$^2$, 0.2 sec.

Thereafter, the steel sheets were rinsed with water and immediately subjected to an electrolytic chromate treatment under the following conditions.

Electrolytic chromate treatment

Bath composition: $CrO_3$ 100 g/l
Bath temperature: 45° C.
Electrolytic conditions: 10 A/dm$^2$, 1.0 sec. Immediately after the electrolytic chromate treatment, the steel sheets were rinsed with cold water and then with hot water, and dried, containing tin-free steel sheets.

Comparative Example 1

After being chromium plated as in Example 1, steel sheets were kept immersed in the chromium plating bath for 5 seconds without effecting reverse electrolysis, rinsed with water, and then treated as in Example 1, obtaining tin-free steel sheets.

EXAMPLE 2

Tin-free steel sheets were produced by repeating the procedure of Example 1 except for the following electrolytic chromate treatment.

Electrolytic chromate treatment

Bath composition: $CrO_3$ 80 g/l+$HBF_4$ 0.09 g/l
Bath temperature: 45° C.
Electrolytic condition: 10 A/dm$^2$, 1.0 sec.

Comparative Example 2

After being chromium plated as in Example 1, steel sheets were kept immersed in the chromium plating bath for 5 seconds without effecting reverse electrolysis, rinsed with water, and immediately thereafter subjected to an electrolytic chromate treatment and post-treatments as in Example 2, obtaining tin-free steel sheets.

EXAMPLE 3

After being pre-treated as in Example 1, steel sheets were chromium plated under the following conditions.

Chromium plating

Bath composition: $CrO_3$ 250 g/l+$H_2SO_4$ 1 g/l+$Na_2SiF_6$ 10 g/l
Bath temperature: 55° C.
Electrolytic conditions: 60 A/dm$^2$, 1.0 sec.

After the chromium plating, the steel sheets were subjected to reverse electrolysis in the same bath under the following conditions.

Reverse electrolysis

Anode: Chromium plated steel sheet
Electrolytic conditions: 5 A/dm$^2$, 0.1 sec.

After the reverse electrolysis, the steel sheets were rinsed with water and immediately subjected to an electrolytic chromate treatment under the following conditions.

Electrolytic chromate treatment

Bath composition: $CrO_3$ 80 g/l+$Na_2SiF_6$ 0.19 g/l
Bath temperature: 45° C.
Electrolytic conditions: 10 A/dm$^2$, 1.0 sec.

Thereafter, the steel sheets were post-treated as in Example 1, obtaining tin-free steel sheets.

Comparative Example 3

After being chromium plated as in Example 1, steel sheets were kept immersed in the chromium plating bath for 2 seconds without effecting reverse electrolysis, rinsed with water, and immediately thereafter subjected to an electrolytic chromate treatment and post-treatments as in Example 3, obtaining tin-free steel sheets.

Peel strength test

The tin-free steel sheets according to the method of the present invention (Examples 1–3) and the tin-free steel sheets according to the prior art method (Comparative Examples 1–3) were processed into test pieces for a peel test.

(1) Test piece preparation

Each of the tin-free steel sheets was coated with an epoxyphenol resin paint or "size coated" on one surface to a paint film quantity of 50±5 mg/dm$^2$, baked at 190° C. for 10 minutes, and then coated with another epoxyphenol resin paint or "gold coated" on the other surface to the same paint film quantity, and baked at 210° C. for 10 minutes. An adhesive synthetic resin (nylon) tape having a thickness of 100 μm and a width of 5 mm was sandwiched between the size coated surface of one sheet and the gold coated surface of another sheet. The sandwich was hot pressed into a test piece at 190° C. and 1 kg/cm$^2$ for 30 seconds.

(2) Test procedure

A test piece prepared by procedure (1), immediately after bonded, was determined for peel strength by subjecting it to a T-peel test using an Instron tensile strength tester at a constant rate of pulling of 200 mm/min.

An additional test piece was determined for peel strength by the same procedure as above after it was immersed in an acidic sugar solution containing 15 g/l of sucrose and adjusted to pH 3.3 with citric acid at 70° C. for 7 days.

Five test pieces were used in each of the tests. The test results are shown in Table 1, which are each an average of five tests. Further, the test results of Example 1 and Comparative Example 1 are plotted in the diagram of FIG. 1. In the diagram, A is a maximum, C is a minimum, B is an average and the range from A to C is depicted by a solid segment.

TABLE 1

| | T-peel strength Bond strength, kg/5 mm width | |
|---|---|---|
| | Immediately after bonding | After immersion in acidic sugar solution at 70° C. for 7 days |
| Example | | |
| 1 | 5.2 | 3.3 |
| 2 | 5.1 | 3.6 |
| 3 | 5.1 | 3.5 |
| Comparative Example | | |
| 1 | 3.7 | 1.2 |
| 2 | 4.1 | 1.6 |
| 3 | 4.2 | 1.8 |

(3) Test result evaluation

As seen from Table 1 and FIG. 1 showing the results of peel strength tests, the steel sheets of Comparative Examples 1–3 according to the prior art method exhibited low peel strength immediately after bonding and markedly reduced their peel strength to less than one-half of the initial strength after the acidic sugar solution immersion.

On the contrary, the steel sheets according to the present invention exhibited higher peel strength than the prior art steel sheets and a reduction of their peel strength by the acidic sugar solution immersion was smaller. That is, the steel sheets according to the present invention not only have increased peel strength immediately after bonding, but also exhibit substantially improved retorting resistance and aging resistance.

Analysis of treated surface

The following analyses were made on specimens which had been chromium plated, reversely electrolyzed in the chromium plating bath, and immediately rinsed and dried as described in Example 1 (to be referred to as "instant specimen", hereinafter), and on specimens which had been chromium plated, immersed in the chromium plating bath for 5 seconds, and immediately rinsed and dried as described in Comparative Example 1 (to be referred to as "prior art specimen", hereinafter).

(1) Metallic chromium quantity

The quantity of metallic chromium deposited was measured for both the instant specimen and the prior art specimen by the electrolytic separation technique. The results, each being an average of five specimens, are shown below.

Instant specimen—93 mg/m$^2$

Prior art specimen—115 mg/m$^2$

This data proves that the metallic chromium is partially dissolved away by the reverse electrolysis according to the present invention.

(2) Electron microscope photograph of metallic chromium

Figure 2:
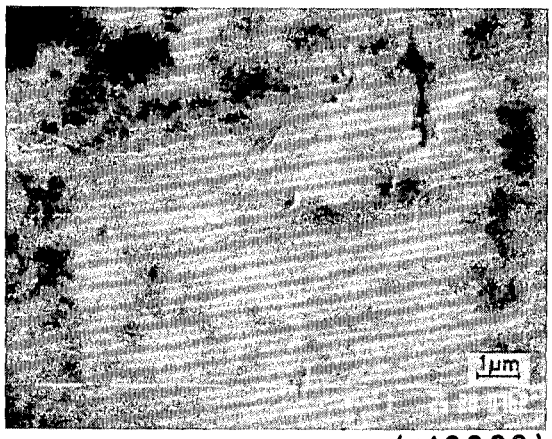
FIGS. 2 and 3 are electron-microscopic photographs showing the surface structures of a specimen which has undergone reverse electrolysis according to the present invention and of a specimen which has not undergone reverse electrolysis as in the prior art, respectively, the magnifying power being 10,000×.
Figure 3:
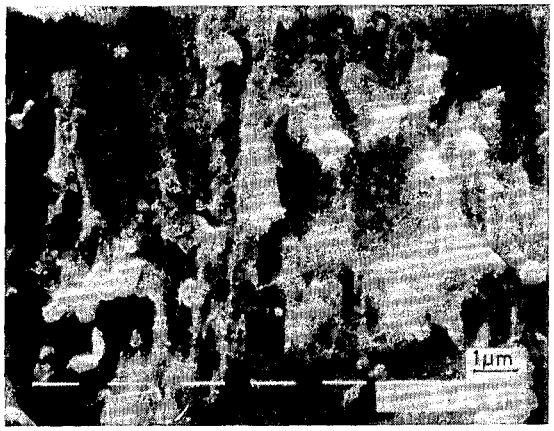

FIGS. 2 and 3 are photos of the instant specimen and the prior art specimen viewed under a scan-type electron microscope with a magnifying power of 10,000×. The photo of FIG. 3 shows that the surface of metallic chromium deposit on the prior art specimen appears irregular or rough as it has dendrite precipitated due to the reduced throwing power of chromium plating.

On the contrary, precipitation of dendrite is not observed in the photo of FIG. 2 showing the instant specimen which has undergone reverse electrolysis. It is believed that the reverse electrolysis causes dissolving current to concentrate on projections on the surface, which are selectively dissolved away, resulting in a smooth surface. This smoothing action appears to advantageously minimize the exposure of metallic chromium from the hydrated chromium oxide coating after the electrolytic chromate treatment, and reduce the disordered structure of the hydrated chromium oxide coating, contributing to a substantial improvement in retorting resistance.

(3) Hydrated chromium oxide quantity

The quantity of hydrated chromium oxides deposited was measured on the instant specimen and the prior art specimen by the fluorescent X-ray method (X-ray 40 kV, 60 mA, monitoring time 60 seconds). Five specimens were used for each measurement and an average was obtained. The results are shown below (calculated in terms of Cr).

Instant specimen—1.5 mg/m$^2$

Prior art specimen—3.4 mg/m$^2$

This data proves that the hydrated chromium oxide coating is partially dissolved away by the reverse electrolysis according to the present invention.

(4) Sulfur content in the hydrated chromium oxide coating

The sulfur content in the hydrated chromium oxide coating was measured on the instant specimen and the prior art specimen by the fluorescent X-ray method (X-ray 40 kV, 60 mA, monitoring time 60 seconds). Five specimens were used for each measurement and an average was obtained. The results are shown below.

Instant specimen—undetectable

Prior art specimen—350 counts

This data proves that the prior art specimen which has not undergone reverse electrolysis has a substantial content of sulfur which indicates that sulfate residues are codeposited with hydrated chromium oxides. The sulfur content of the instant specimen is substantially lower to—below the limit of detection by the fluorescent X-ray method, which proves that substantially no sulfate residue is codeposited, proving that the reverse electrolysis as used in the present invention is very effective in eliminating the undesirable anions codeposited.

As apparent from the foregoing, tin-free steel sheets having undergone reverse electrolysis according to the present invention have improved adhesion to paint film and are suitable for the manufacture of coffee and food cans subject to retorting treatment. It is to be noted that although tin-free steel sheets according to the present invention are coated with size and gold paints on opposite surfaces in the preferred embodiment of the present invention, other paints based on organic solvents may be equally used for such coating purpose. Further, the adhesives which can be used with the tin-free steel sheets according to the present invention are not limited to nylon type adhesives.

What is claimed is:

1. A method of producing a tin-free steel sheet having improved retorting resistance, by a dual electrolyte process comprising:

chromium plating a steel sheet through cathodic electrolysis in a chromium ion-containing first aqueous solution that contains sulfur, to form a plating of metallic chromium with a superposed layer of hydrated chromium oxides, subjecting the thus-plated steel sheet to reverse electrolysis in the same chromium plating bath with a quantity of electricity from 0.1 to 15 coulomb/dm$^2$ to cause the metallic chromium and hydrated chromium oxide coatings to be partially dissolved out together with the assistant anions codeposited in the hydrated chromium oxide coating, rinsing the steel sheet in a water bath, and subjecting the reversely electrolyzed steel sheet to cathodic electrolysis in a second aqueous solution which is substantially free of sulfur and contains at least one member selected from the group consisting of chromium acid, chromates, and dichromates, until a layer of hydrated chromium oxides of substantial thickness has added to the layer of hydrated chromium oxides remaining after said reverse eledtrolyzing and the total quantity fo hydrated chromium oxides is 5 to 30 mg (in terms of metallic chromium) per square meter of the surface.

2. The method according to claim 1 wherein the resulting steel sheet has 20 to 200 mg/m$^2$ of the metallic chromium coating and 5 to 50 mg/m$^2$ of the hydrated chromium oxide coating.

* * * * *